US011519241B2

(12) United States Patent
Ali et al.

(10) Patent No.: US 11,519,241 B2
(45) Date of Patent: Dec. 6, 2022

(54) DRILL ASSEMBLY HAVING A STINGER WITH DOWNWARD ORIENTED CUPS

(71) Applicant: Saudi Arabian Oil Company, Dhahran (SA)

(72) Inventors: Syed Muhammad Ali, Abqaiq (SA); Victor Jose Bustamante Rodriguez, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/178,689

(22) Filed: Feb. 18, 2021

(65) Prior Publication Data

US 2022/0259939 A1 Aug. 18, 2022

(51) Int. Cl.

| | |
|---|---|
| ***E21B 33/126*** | (2006.01) |
| ***E21B 12/00*** | (2006.01) |
| ***E21B 33/13*** | (2006.01) |
| *E21B 17/06* | (2006.01) |

(52) U.S. Cl.

CPC ..... *E21B 33/126* (2013.01); *E21B 12/00* (2013.01); *E21B 33/13* (2013.01); *E21B 17/06* (2013.01)

(58) Field of Classification Search

CPC ..... E21B 33/126; E21B 33/13; E21B 12/00; E21B 17/06

See application file for complete search history.

(56) References Cited

U.S. PATENT DOCUMENTS

| | | | | |
|---|---|---|---|---|
| 2,014,563 | A | 9/1935 | Halliburton | |
| 2,058,688 | A | 10/1936 | Halliburton | |
| 2,801,715 | A | 8/1957 | Hall, Sr. | |
| 3,760,878 | A * | 9/1973 | Peevey | E21B 37/08 166/185 |
| 5,957,198 | A * | 9/1999 | Haynes | E21B 43/10 166/334.1 |
| 6,578,638 | B2 | 6/2003 | Guillory et al. | |
| 7,380,603 | B2 | 6/2008 | Jeffrey et al. | |
| 7,717,179 | B2 | 5/2010 | Raysiguier et al. | |
| 10,053,949 | B2 | 8/2018 | Frazier | |
| 10,626,698 | B2 | 4/2020 | Al-Mousa et al. | |
| 2005/0263282 | A1* | 12/2005 | Jeffrey | E21B 23/01 166/281 |
| 2008/0066917 | A1* | 3/2008 | Lehr | E21B 43/261 166/308.1 |
| 2011/0162844 | A1 | 7/2011 | Mauth et al. | |
| 2020/0224517 | A1* | 7/2020 | Duncan | E02D 23/00 |
| 2020/0340332 | A1* | 10/2020 | Anderson | E21B 37/08 |

* cited by examiner

*Primary Examiner* — Taras P Bemko
(74) *Attorney, Agent, or Firm* — Leason Ellis LLP

(57) ABSTRACT

A drill assembly has a stinger with downward oriented cups including an upper cup and a lower cup. The cups create a loss zone therebetween in a downhole environment. The downhole environment can be a shaft of a well. The loss zone can be filled with cement to plug the shaft. The downward oriented cups isolate the loss zone from the shaft and minimize the hydrostatic pressure above the upper cup.

15 Claims, 3 Drawing Sheets

DRILL ASSEMBLY HAVING A STINGER WITH DOWNWARD ORIENTED CUPS

FIELD OF THE DISCLOSURE

The present disclosure relates generally to drill assemblies, and, more particularly, to a drill assembly having a stinger with downward oriented cups.

BACKGROUND OF THE DISCLOSURE

During the operation of wells and other drilling activities, problems can occur in which petroleum or natural gas flow uncontrollably in or around a well shaft. Such problems result in losses of valuable petroleum or natural gas. Accordingly, actions are taken in the well to minimize or stop such losses. Other losses include mud losses and water losses which adversely affect the well. One remedy is to place cement plugs in the case of total losses. However, there is the risk of well plugging apparatuses getting stuck while trying to cure losses, such as when using a cement squeeze swap cup assembly as when trying to place the cement plugs or when the cement settling/thickening time is very minimal.

Some publications describe attempts to plug wells. U.S. Pat. No. 7,380,603 describes a tool which is used for abandonment of a well, with that disclosure focusing on some exposed formations which could leak fluid to the surface if not abandoned properly. The tool is also anchored to a current casing already deployed in order to allow proper abandonment with cement and utilizes mechanisms to release the section which is not part of the tool.

U.S. Pat. No. 10,626,698 describes a tool to squeeze cement and seal areas where the casing was damaged and which allow communication and flow of fluids in the well. perforations are needed to squeeze cement behind the casing and into the open hole to squeeze cement downhole to have a seal or to abandon a section. This tool can be left in the hole or retrieved to continue with the workover operations, using "packers" which are set to the casing. This tool is for cased holes only.

U.S. Pat. No. 10,053,949 is a typical cement retainer to be set in a cased hole, and a procedure is utilized to squeeze cement for well repairment or to solve leaking problems. U.S. Pat. No. 7,717,179 describes a tool for setting hydraulics plugs, which could use any fluid or cement. The tool is left in the hole with its lower part abandoned. U.S. Patent Publication 2011/0162844 places a cement plug by leaving the full assembly on the bottom and retrieving only the drill pipe connected on the top. This is a one-way trip. The plug is set with a small clearance, leaving only cement on this area which can be easily removed while milling the assembly.

In the event of total losses, any hydrostatic column and resulting pressure from the hydrostatic column in the well could affect the setting of the cement plug.

It is with respect to this environment that the present disclosure is directed.

SUMMARY OF THE DISCLOSURE

According to an embodiment consistent with the present disclosure, a drill assembly has a stinger with downward oriented cups including an upper cup and a lower cup. The cups create a loss zone therebetween in a downhole environment. The downhole environment is a shaft of a well in one application. The loss zone is filled with cement to plug the shaft. The downward oriented cups isolate the loss zone from the shaft and minimize the hydrostatic pressure above the upper cup.

In the embodiment, the cups on the stinger cure losses as well as minimize the hydrostatic pressure. Accordingly, the pumped cement does not go immediately to the loss zone and thereby provides time for settling. In case the cement sets too fast, the drill assembly is cemented in the hole such that an upper section can be released, and then the cement and cups can be milled or drilled. If this does not occur, the entire drill assembly can be pulled out of the hole (POOH) to the surface. The cups employed in the drill assembly are not packers and can be used in a casing or an open hole.

The drill assembly can be a retrieval string and is employed in case there is an issue with cement flash setting. In this event, the drill assembly can be left in the hole and only disconnected from the top. The drill assembly establishes isolation above the loss zone or above an expected cement plug top, so there is a greater chance of having successful losses cement plug. Also due to the fast settling cement time, which for this type of operations are very minimal, the material proposed for drill assembly can be fabricated with fiber which is easily drillable in case the cement drill assembly is cemented while setting the plug.

Accordingly, the drill assembly provides isolation of the loss zone from the hydrostatic pressure above the losses through the use of two rubber cups facing down which are part of the cementing stinger and provides the use of fiber material on the drill assembly to allow the drilling of the drill assembly in case the drill assembly is cemented while the plug is pumped.

In an embodiment, a drill assembly comprises an elongated stinger, a sealing member, and a cup. The elongated stinger has a longitudinal axis oriented vertically. The cup is mounted to the stinger by the sealing member. The cup extends around the longitudinal axis of the stinger. The cup includes a top curved portion, and an open bottom portion oriented downward along the longitudinal axis. An outer surface of the cup comprises the top curved portion and is oriented upward, and the outer surface is contiguous and uninterrupted. The cup comprises a rim. The cup has a first configuration with the rim at the union of the outer surface of the top curved portion and of the bottom portion, in which the rim defines a first dimension, and the cup is collapsible from the first configuration to a second configuration in which the rim defines a second dimension. The second dimension is less than the first dimension. The cup is collapsible to move the rim upward toward the sealing member and parallel to the longitudinal axis. Alternatively, the cup is collapsible to move the rim downward away from the sealing member and parallel to the longitudinal axis. The cup is composed of rubber.

In another embodiment, a drill assembly is extendable in a downhole environment. The drill assembly comprises a drill pipe, an elongated stinger, a sealing member, a drill bit, and at least one cup. The elongated stinger has a longitudinal axis oriented vertically. The stinger is mounted at a lower end of the drill pipe. The drill bit is mounted at a lower end of the stinger. The at least one cup is mounted to the stinger by the sealing member. The at least one cup extends around the longitudinal axis of the stinger. The at least one cup includes a top curved portion, and an open bottom portion oriented downward along the longitudinal axis. An outer surface of the at least one cup comprises the top curved portion and is oriented upward, and the outer surface is contiguous and uninterrupted.

The at least one cup comprises a first cup disposed between an upper portion and an intermediate portion of the stinger, and a second cup disposed between the intermediate portion and a lower portion of the stinger. The first and second cups define a loss zone therebetween to receive cement plugging the downhole environment. The at least one cup comprises a rim. The at least one cup has a first configuration with the rim at the union of the outer surface of the top curved portion and of the bottom portion, in which the rim defines a first dimension. The cup is collapsible from the first configuration to a second configuration in which the rim defines a second dimension. The second dimension is less than the first dimension.

The at least one cup is collapsible to move the rim upward toward the sealing member and parallel to the longitudinal axis. Alternatively, the at least one cup is collapsible to move the rim downward away from the sealing member and parallel to the longitudinal axis. The at least one cup is composed of rubber. The drill assembly comprises a safety joint disposed between the drill pipe and an upper portion of the stinger.

In a further embodiment, a method is configured to plug a downhole environment. The method comprises providing an elongated stinger having a longitudinal axis oriented vertically, providing a sealing member, and providing at least one collapsed cup. The at least one cup extends around the longitudinal axis of the stinger, with the at least one cup including a rim, a top curved portion, and an open bottom portion oriented downward along the longitudinal axis. An outer surface of the at least one cup comprises the top curved portion and oriented upward. The outer surface is contiguous and uninterrupted. The method further comprises mounting the at least one collapsed cup to the stinger by the sealing member, positioning the stinger in the downhole environment, moving the rim parallel to the longitudinal axis to expand the at least one collapsed cup, creating a loss zone in the downhole environment adjacent to the expanded at least one cup, and filling the loss zone with material to plug the downhole environment.

The at least one cup includes a first cup and a second cup. The first cup is disposed between an upper portion and an intermediate portion of the stinger. The second cup is disposed between the intermediate portion and a lower portion of the stinger. The first and second cups create the loss zone therebetween to receive the material plugging the downhole environment.

Moving the rim comprises moving portions of the rim from a first configuration with rim defining a first dimension to a second configuration with the rim defining a second dimension. The second dimension is less than the first dimension. The rim moves upward parallel to the longitudinal axis and toward the sealing member. Alternatively, the rim move downward parallel to the longitudinal axis and away from the sealing member. Moving the rim parallel to the longitudinal axis flexes the at least one cup to expand the at least one collapsed cup.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION OF CERTAIN EMBODIMENTS OF THE DISCLOSURE

Figure 1:
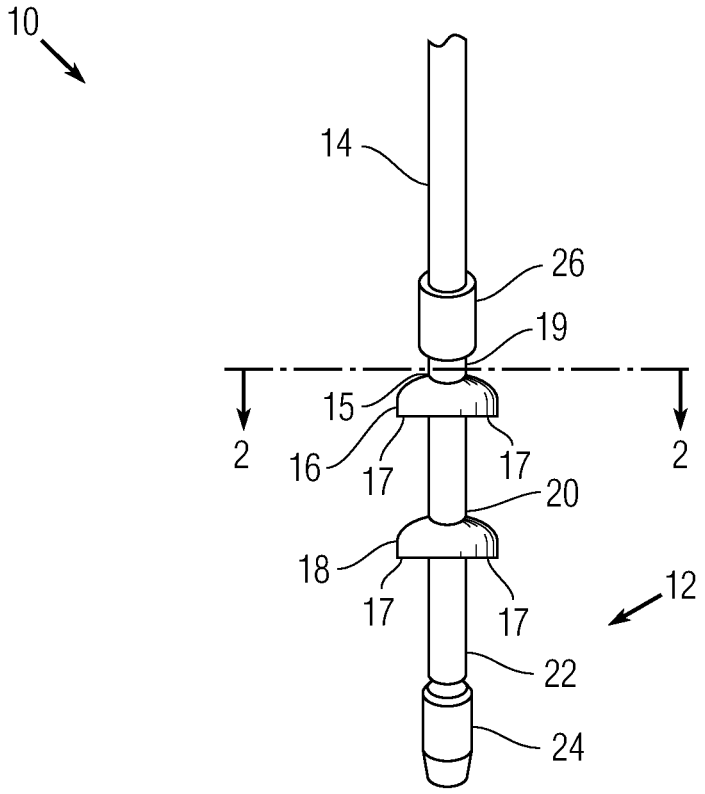
FIG. 1 illustrates a side elevational view of a drill assembly, according to an embodiment.

Example embodiments consistent with the teachings included in the present disclosure are directed to a drill assembly 10 having a stinger 12 with downward oriented cups 16, 18. As shown in FIGS. 1-6, the drill assembly 10 is extendable in a downhole environment, such as a shaft in a well. The drill assembly 10 comprises a drill pipe 14, the elongated stinger 12, a sealing member 15, a drill bit 24, and at least one cup 16, 18. The at least one cup 16, 18 can include an upper cup 16, and a lower cup 18. The elongated stinger 12 has a longitudinal axis oriented vertically. The stinger 12 is mounted at a lower end of the drill pipe 14. The drill bit 24 is mounted at a lower end of the stinger 12. The at least one cup 16, 18 is mounted to the stinger 12 by the sealing member 15. The at least one cup 16, 18 extends around the longitudinal axis of the stinger 12. The at least one cup 16, 18 includes a top curved portion, and an open bottom portion oriented downward along the longitudinal axis. An outer surface 28 of the at least one cup 16, 18 comprises the top curved portion and is oriented upward, and, in the illustrated embodiment, the outer surface is contiguous and uninterrupted with the stinger. In a further embodiment, shown in FIG. 1, the drill assembly 10 comprises a safety joint 26 disposed between the drill pipe 14 and the upper portion 19 of the stinger 12.

Since the outer surface is contiguous and uninterrupted with the stinger, the at least one cup 16, 18 can be deformed to collapse and expand, as described below, to provide a seal in the well to fully isolate the loss zone without any structures passing through the outer surface which would compromise the isolation of the loss zone. Accordingly, the at least one cup 16, 18 maintains hydrostatic pressure above the at least one cup 16, 18.

Figure 2:
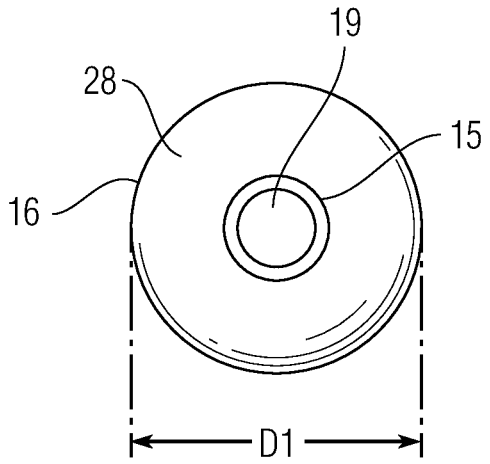
FIG. 2 illustrates a cross-sectional view of the drill assembly of FIG. 1 along lines 2-2.

The at least one cup 16, 18 includes a first cup 16 disposed between an upper portion 19 and an intermediate portion 20 of the stinger 12, and a second cup 18 disposed between the intermediate portion 20 and a lower portion 22 of the stinger. The first cup 16 and the second cup 18 define a loss zone therebetween to receive material plugging the downhole environment. The material can be cement. The at least one cup 16, 18 comprises a rim 17. The at least one cup 16, 18 has a first configuration with the rim 17 defining a first dimension D1, as shown in FIGS. 1-2. The at least one cup 16, 18 is collapsible from the first configuration to a second configuration with the rim defining a second dimension, as shown in FIGS. 3-6. In one embodiment, shown in FIGS. 3-4, the second dimension is the dimension D2. The second dimension D2 is less than the first dimension D1. In another embodiment, shown in FIGS. 5-6, the second dimension is the dimension D3. The second dimension D3 is less than the first dimension D1 and different than D2.

Figure 3:
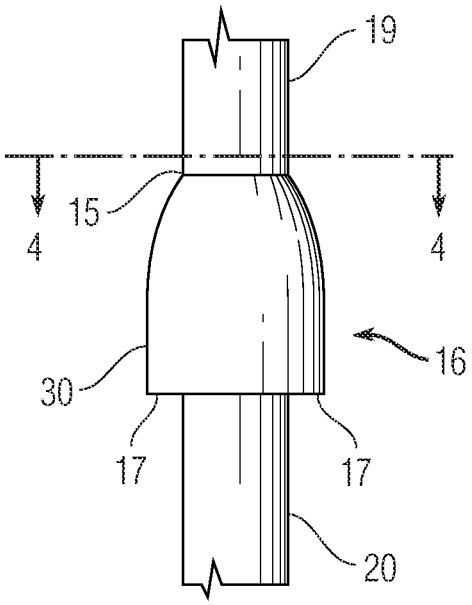
FIG. 3 illustrates a side elevational view of a portion of the drill assembly of FIG. 1.
Figure 4:
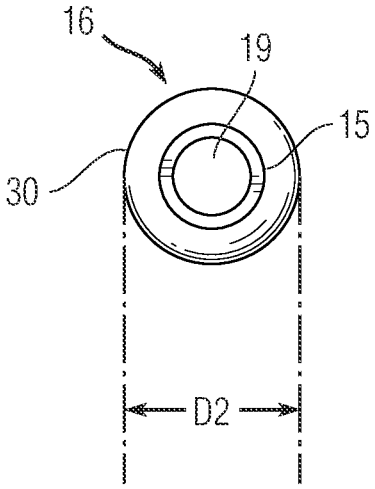
FIG. 4 illustrates a cross-sectional view of the drill assembly of FIG. 3 along lines 4-4.

In the embodiment shown in FIGS. 3-4, the at least one cup 16, 18 is collapsible to move the rim 17 downward from the first configuration shown in FIGS. 1-2 toward the sealing member 15 and parallel to the longitudinal axis of the stinger 12. For example, the rim 17 moves until the cup 16 attains a first collapsed configuration 30 shown in FIGS. 3-4. The at least one cup 16, 18 is composed of an elastic material, such as rubber. The rubber has a stiffness yet is suitable if it has sufficient flexibility to be collapsible and expandable again between the D1 and D2 or D3 dimensions. With the cups 16, 18 in the first collapsed configuration 30, the stinger 12 passes through the shaft in the downhole environment. Once the stinger 12 is positioned at a specific location in the shaft, the cups 16, 18 expand from the first collapsed configuration 30 in FIGS. 3-4 to the expanded configuration shown in FIGS. 1-2.

Figure 5:
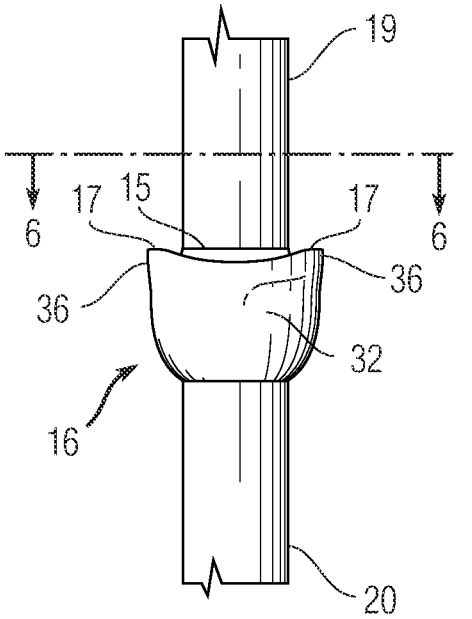
FIG. 5 illustrates a side elevational view of a portion of the drill assembly of FIG. 1.
Figure 6:
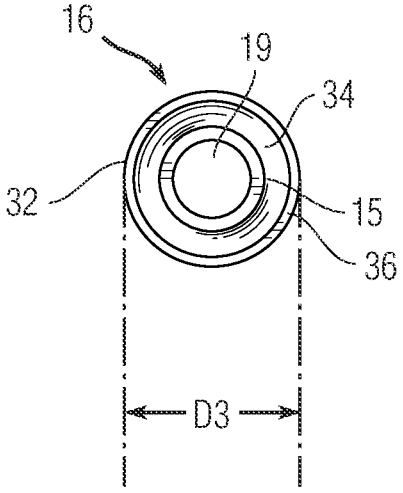
FIG. 6 illustrates a cross-sectional view of the drill assembly of FIG. 5 along lines 6-6.

Alternatively, in the embodiment shown in FIGS. 5-6, the at least one cup 16, 18 is collapsible to move the rim 17 upward away from the sealing member 15 and parallel to the longitudinal axis of the stinger 12. For example, the rim 17 moves until the cup 16 attains a second collapsed configuration 32 shown in FIGS. 5-6. The top 34 of the cup 16 is bent upward, and the bottom 36 of the cup 16 is bent further upward. With the cups 16, 18 in the second collapsed configuration 32, the stinger 12 passes through the shaft in the downhole environment. Once the stinger 12 is positioned at a specific location in the shaft, the cups 16, 18 expand from the second collapsed configuration 32 in FIGS. 5-6 to the expanded configuration shown in FIGS. 1-2.

Figure 7:
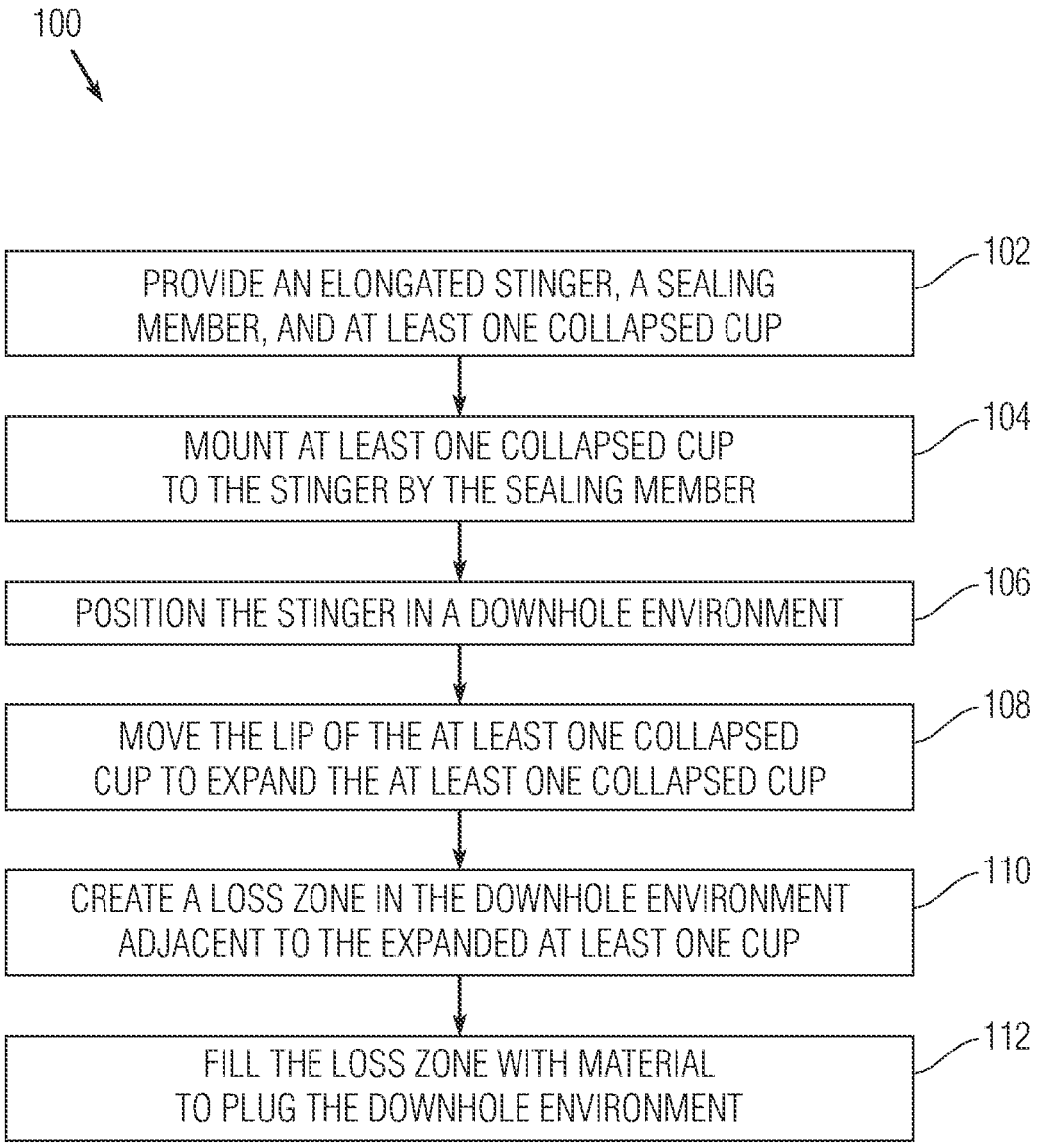
FIG. 7 illustrates a flowchart of a method, according to the embodiment.

As shown in FIG. 7, a method 100 of operation of use of the drill assembly 10 includes the step of providing 102 the elongated stinger 12, the sealing member 15, and the at least one cup 16, 18 in a collapsed state. The at least one collapsed cup 16, 18 is mounted 104 to the stinger 12 by the sealing member 15, and this can be done before or together with the providing step. The stinger 12 is positioned 106 in a downhole environment. A rim 17 of the at least one collapsed cup 16, 18 is moved 108 to expand the at least collapsed cup 16, 18 into contact with the shaft or any liner or casing in the downhole environment. The expanded at least one cup 16, 18 creates 110 a loss zone in the downhole environment adjacent to the expanded at least one cup 16, 18, and the loss zone is then filled 112 with material such as cement to plug the downhole environment.

In further embodiments, the stinger 12 can be composed of fiber tubing. The fiber composition of the stinger 12 creates a drillable stinger 12 in the event that a future drilling operation must drill through the cement plug with the stinger 12 therein.

It is to be further understood that like or similar numerals in the drawings represent like or similar elements through the several figures, and that not all components or steps described and illustrated with reference to the figures are required for all embodiments or arrangements.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third) is for distinction and not counting. For example, the use of "third" does not imply there is a corresponding "first" or "second." Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims.

The subject matter described above is provided by way of illustration only and should not be construed as limiting. Various modifications and changes can be made to the subject matter described herein without following the example embodiments and applications illustrated and described, and without departing from the true spirit and scope of the invention encompassed by the present disclosure, which is defined by the set of recitations in the following claims and by structures and functions or steps which are equivalent to these recitations.

What is claimed is:

1. A drill assembly extendable in a downhole environment, comprising:
- a drill pipe;
- an elongated stinger having a longitudinal axis oriented vertically, with the stinger mounted at a lower end of the drill pipe;
- a sealing member;
- a drill bit mounted at a lower end of the stinger; and
- at least one cup mounted to the stinger by the sealing member, with the at least one cup extending around the longitudinal axis of the stinger, and with the at least one cup including:
  - a rim;
  - a top curved portion; and
  - an open bottom portion oriented downward along the longitudinal axis, wherein the bottom portion is open between the rim and the stinger;
- wherein an outer surface of the at least one cup comprises the top curved portion and is oriented upward, and the outer surface is contiguous and uninterrupted.

2. The drill assembly of claim 1, wherein the at least one cup comprises:
- a first cup disposed between an upper portion and an intermediate portion of the stinger; and
- a second cup disposed between the intermediate portion and a lower portion of the stinger.

3. The drill assembly of claim 2, wherein the first and second cups define a loss zone therebetween to receive cement plugging the downhole environment.

4. The drill assembly of claim 1, wherein the at least one cup has a first configuration with the rim at the union of the outer surface of the top curved portion and of the bottom portion, in which the rim defines a first dimension, wherein the at least one cup is collapsible from the first configuration to a second configuration in which the rim defines a second dimension, and wherein the second dimension is less than the first dimension.

5. The drill assembly of claim 4, wherein the at least one cup is collapsible to move the rim upward toward the sealing member and parallel to the longitudinal axis.

6. The drill assembly of claim 4, wherein the at least one cup is collapsible to move the rim downward away from the sealing member and parallel to the longitudinal axis.

7. The drill assembly of claim 1, wherein the at least one cup is composed of rubber.

8. The drill assembly of claim 1, further comprising:

a safety joint disposed between the drill pipe and an upper portion of the stinger.

9. A method configured to plug a downhole environment, comprising:

providing an elongated stinger having a longitudinal axis oriented vertically;

providing a sealing member;

providing at least one collapsed cup, with the at least one cup extending around the longitudinal axis of the stinger, with the at least one cup including a rim, a top curved portion, and an open bottom portion oriented downward along the longitudinal axis, wherein the bottom portion is open between the rim and the stinger, with an outer surface of the at least one cup comprising the top curved portion and oriented upward, and with the outer surface being contiguous and uninterrupted;

mounting the at least one collapsed cup to the stinger by the sealing member;

positioning the stinger in the downhole environment;

moving the rim parallel to the longitudinal axis to expand the at least one collapsed cup;

creating a loss zone in the downhole environment adjacent to the expanded at least one cup; and filling the loss zone with material to plug the downhole environment.

10. The method of claim 9, wherein the at least one cup includes:

a first cup disposed between an upper portion and an intermediate portion of the stinger; and a second cup disposed between the intermediate portion and a lower portion of the stinger.

11. The method of claim 10, wherein the first and second cups create the loss zone therebetween to receive the material plugging the downhole environment.

12. The method of claim 9, wherein moving the rim comprises:

moving portions of the rim from a first configuration with rim defining a first dimension to a second configuration with the rim defining a second dimension, with the second dimension being less than the first dimension.

13. The method of claim 12, wherein the rim moves upward parallel to the longitudinal axis and toward the sealing member.

14. The method of claim 12, wherein the rim moves downward parallel to the longitudinal axis and away from the sealing member.

15. The method of claim 9, wherein moving the rim parallel to the longitudinal axis flexes the at least one cup to expand the at least one collapsed cup.

* * * * *